US006966752B2

(12) United States Patent
Gieg et al.

(10) Patent No.: US 6,966,752 B2
(45) Date of Patent: Nov. 22, 2005

(54) CASING RING

(75) Inventors: Walter Gieg, Eichenau (DE); Helmut Groess, Vierkirchen (DE); Klemens Hain, Wiedenzhausen (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 10/476,971

(22) PCT Filed: Mar. 28, 2002

(86) PCT No.: PCT/DE02/01150

§ 371 (c)(1),
(2), (4) Date: Jun. 2, 2004

(87) PCT Pub. No.: WO02/090724

PCT Pub. Date: Nov. 14, 2002

(65) Prior Publication Data

US 2004/0213666 A1 Oct. 28, 2004

(30) Foreign Application Priority Data

May 9, 2001 (DE) ..... 101 22 464

(51) Int. Cl.[7] ..... F01D 11/12

(52) U.S. Cl. ..... 415/173.4; 415/173.5; 415/173.6; 415/178; 415/209.2; 415/209.3

(58) Field of Search ..... 415/108, 173.1, 415/173.4, 173.5, 173.6, 173.7, 178, 209.2, 209.3; 277/412, 414–416, 421

(56) References Cited

U.S. PATENT DOCUMENTS

| | | | | |
|---|---|---|---|---|
| 4,242,042 A | | 12/1980 | Schwarz | |
| 4,512,712 A | | 4/1985 | Baran, Jr. | |
| 4,867,639 A | * | 9/1989 | Strangman | 415/173.4 |
| 4,925,365 A | | 5/1990 | Crozet et al. | |
| 5,240,518 A | | 8/1993 | Linko, III et al. | |

FOREIGN PATENT DOCUMENTS

| | | |
|---|---|---|
| EP | 0 618 349 A | 10/1994 |
| EP | 0 844 369 A | 5/1998 |
| EP | 0 974 734 A | 1/2000 |

* cited by examiner

*Primary Examiner*—Christopher Verdier
(74) *Attorney, Agent, or Firm*—Crowell & Moring LLP

(57) ABSTRACT

A jacket ring for the low-pressure-turbine region of a gas turbine, having a plurality of lined-up segments which are arranged between a moving blade ring with a shroud band and the casing of the gas turbine, which carry a run-in lining and which hold guide blades in a positive-locking manner, wherein each segment comprises a hot-gas-side seal carrier and a casing-side securing element, the seal carrier and the securing element are at the greatest possible distance from one another and only have common contact points which are as small as possible, and the securing element is axially supported directly on the casing of the gas turbine.

20 Claims, 1 Drawing Sheet

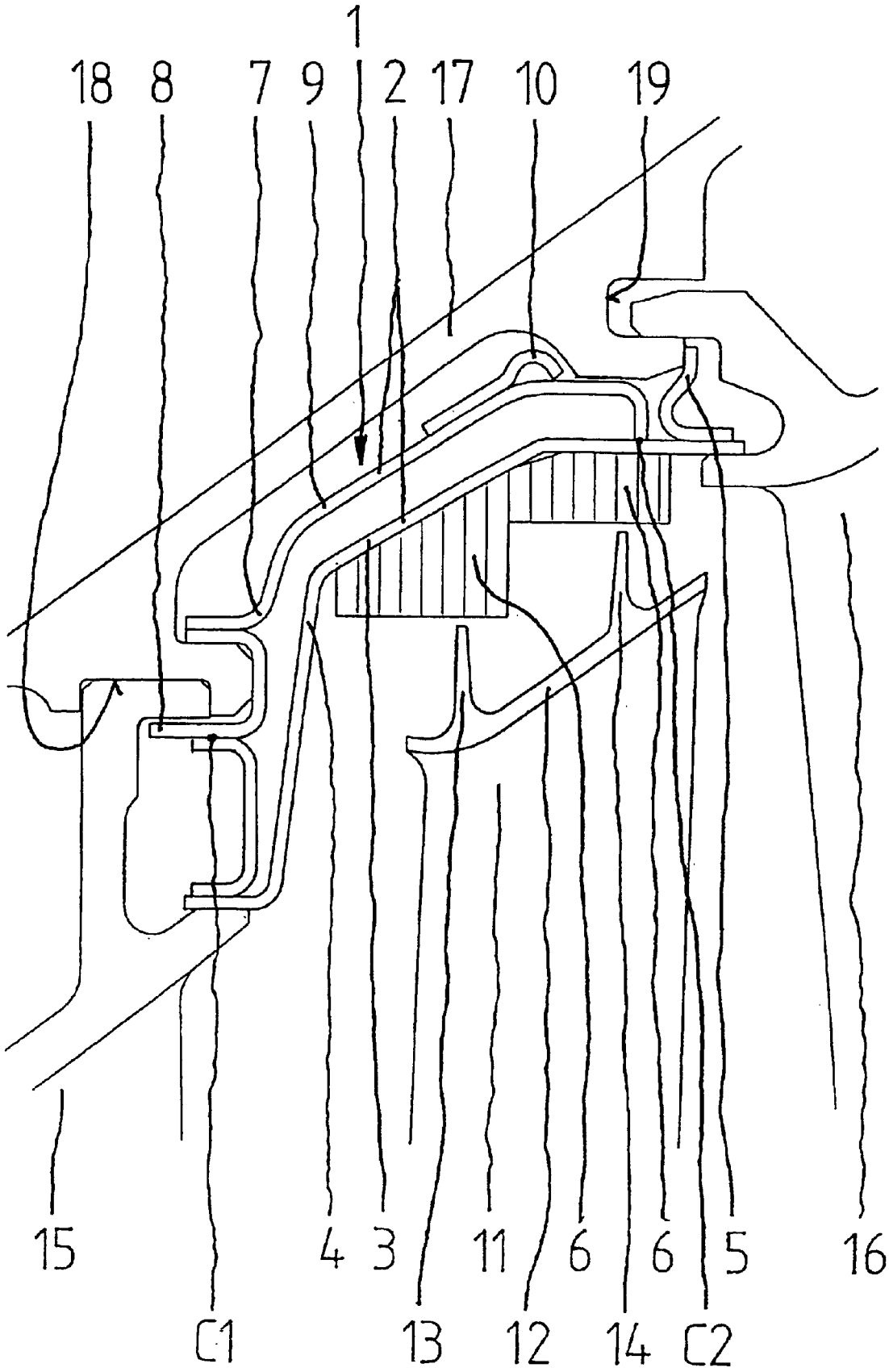
1
18
8
7
9
2
17
10
19
15
C1
4
3
13
11
12
6
14
6
C2
5
16

CASING RING

This application claims the priority of German patent document 101 22 464.8, filed 9 May 2001 (PCT International Application No.: PCT/DE02/01150, filed 28 Mar. 2002), the disclosure of which is expressly incorporated by reference herein.

BACKGROUND AND SUMMARY OF THE INVENTION

The invention relates to a jacket ring for the axial-flow low-pressure-turbine region and/or power-turbine.

In low-pressure turbines and power turbines of gas turbines for aircraft, land vehicles and watercraft and also for stationary use, segmented jacket rings (Outer Air Seals, OAS) are arranged above the moving blades and have the following tasks:

- screening of the casing of the gas turbine from the high gas temperatures,
- providing a run-in lining for the sealing tips at the moving-blade shroud band, and
- often also securing the upstream guide-blade stage in the casing by positive locking.

According to the prior art, at least the last two tasks are assumed by one component, i.e. by the respective jacket ring segment. To fulfill the first task, it is often necessary to arrange additional heat insulation material between the jacket ring and the gas turbine casing enclosing said jacket ring from outside, which increases the costs, the weight and the effort involved during assembly.

Due to the high heat transfer from the run-in lining, usually a honeycomb structure, into the jacket ring segments, which of course also fulfill the guide-blade securing function, the segments become very hot with the following adverse effects:

- heating of the guide-blade fastening elements on the casing and of the casing itself by direct, heat-conducting contact,
- drop in the strength and in the wear resistance of the heated parts,
- dimensional changes and relative movements in the region in which the guide blades are secured, and thus wear and the requirement for large clearances particularly in the axial direction.

The combination of the two last-mentioned effects has in some cases led to the guide-blade securing function failing as a result of plastic deformations and thus to one or more guide blades being released during operation, thus resulting in considerable damage to or destruction of the turbine region affected.

Such a conventional design of the jacket rings has been disclosed, for example, by DE-C-27 45 130. Here, the jacket rings are designated by "covers (10)" or by "jacket ring covers (10)" and the run-in linings by "sealing surfaces (11)". The casing (13) of the gas turbine has fastening elements (cylinders 14) which carry both the guide blades (1) and the jacket rings (covers 10). The radially outer, upstream ends of the guide blades (1) enclose widened portions (beads 22) of the fastening elements in a claw-like manner, and the downstream ends of the jacket rings do this in the same way. The radially outer, downstream ends of the guide blades (1) bear radially from inside against the fastening elements (cylinders 14) and are secured in a positive-locking manner by the claw-like, upstream ends of the jacket rings. Due to the construction, therefore, the thermal and mechanical problems already described exist here too.

Against this background, an object of the invention is to design a segmented jacket ring having a sealing carrier function and a guide-blade securing function in such a way that, by thermal relief of the guide-blade fastening points and of the turbine casing, the mechanical loading capacity is increased and thus wear and plastic deformations are greatly reduced or avoided. At the same time, in particular the guide-blade securing function is to be fulfilled with the greatest reliability.

This object is achieved by a plurality of segments which are lined up in the circumferential direction and are arranged radially outside a moving blade ring with a shroud band and inside the casing of the gas turbine, which carry a run-in lining for at least one sealing tip of the shroud band and which hold guide blades in a positive-locking manner at their radially outer downstream end, said guide blades being arranged upstream of the moving blade ring. Each segment (2) comprises a hot-gas-side seal carrier (3), provided with the run-in lining (6), and a casing-side securing element (7) supporting at least one upstream guide blade (15) and extending axially to an extent comparable with the seal carrier (3), in that the seal carrier (3) and the securing element (7) are at a distance from one another over regions of their surfaces which are as large as possible and only have common, heat-conducting contact points (Cl, C2) which are as small as possible, and in that the securing element (7) is axially supported directly on the casing (17) of the gas turbine via a stop part (10).

According to the invention, the seal carrier function on the one hand and the guide-blade securing function on the other hand are in each case fulfilled by a separate component, so that each segment of the jacket ring comprises a seal carrier and a securing element. The seal carrier and the securing element touch one another, but are not firmly connected to one another. The seal carrier and the securing element are designed in relation to one another in such a way that they are at a distance from one another over regions of their surfaces which are as large as possible and only have common, heat-conducting contact points which are as small as possible. The seal carrier more or less absorbs the local temperature of the hot gas during operation, whereas the securing element remains at a markedly lower temperature due to the screening effect of the seal carrier with minimized heat conduction. As a result, the casing-side guide-blade fastening elements also remain markedly cooler during operation and can be loaded mechanically to a considerably higher degree. The temperature reduction continues right into the turbine casing, in the course of which the screening effect of the shell-like securing element also comes to bear. Additional heat-insulation measures or materials are thus as a rule no longer necessary. Owing to the fact that the securing element is axially supported directly on the casing, the guide-blade securing function continues to be reliably fulfilled within the entire operating range irrespective of thermal expansions of the following guide blades.

Other objects, advantages and novel features of the present invention will become apparent from the following detailed description of the invention when considered in conjunction with the accompanying drawings.

BRIEF DESCRIPTION OF THE DRAWINGS

FIG. 1 shows a simplified partial longitudinal section through an outer blade-sealing and casing region of a low-pressure turbine of a turbojet engine in accordance with an embodiment of the present invention.

DETAILED DESCRIPTION OF THE DRAWINGS

The turbine region which can be seen from the FIGURE is the low-pressure-turbine region or power-turbine region, the latter in the case of a shaft-power gas turbine. In the case of triple-shaft powerplants, this region could also be the intermediate-pressure turbine region. Here, the direction of flow is to run from left to right, the casing-side passage boundary rising in a divergent manner from the bottom left to the top right. The longitudinal center axis/rotation axis of the gas turbine would run horizontally and below the region of the FIGURE; the hub region likewise lies too deep in order to be covered by the illustration.

The moving blade ring 11 to be sealed has a shroud band 12 with two sealing tips 13, 14, which interact with a run-in lining 6, here stepped in diameter, of honeycomb structure. Guide blades 15, 16 can be seen upstream and downstream of the moving blade ring 11 and are arranged statically in the casing 17 of the turbine as individual parts or as segments composed of a plurality of blades. The radially outer, downstream end of the guide blade 15—or of the guide blade segment—lies in a slot 18 which is open radially inward and runs all round the casing 17. The radially outer, upstream end of the guide blade 16—or of the guide blade segment—engages in a slot 19 which is open axially toward the rear and runs all round the casing 17. The guide blade 15 also has a comparable, upstream suspension (on the left outside the illustration). It can be imagined that the guide blade 15, without further securing measures in the casing, and in the hub region, could escape from the slot 18 by radial movement inward in a pivoting manner about its upstream suspension (see region around item 19). This is where the retaining and securing function of the jacket ring 1 comes in, which ring extends axially from the guide blade 15 up to the guide blade 16 and in the circumferential direction round the casing 17. The prior art is to design jacket rings in a segmented manner; however, a special feature of the present invention is to subdivide the segments 2 into further components having defined functions. Here, a seal carrier 3 is arranged on the hot-gas side and holds the run-in lining 6 as part of the Outer Air Seal (OAS). There is a securing element 7 here on the casing side, this securing element 7, in its primary function, securing the guide blade 15 so as to prevent it from escaping from the slot 18. Here, the seal carrier 3, in addition to the run-in lining 6, comprises a shell-like carrier part 4 and a stop part 5 which is hook-like in axial section. Since a plurality of such seal carriers 3 are positioned adjacent to one another over the turbine circumference, there may be additional sealing elements, such as tongues, straps, etc., on these seal carriers 3. However, these are not shown. The seal carrier 3 is movable axially within certain limits, the foremost position with effective stop part 5 being shown here. Since the inner contours of the run-in lining 6 which are effective from the sealing point of view are in each case cylindrical and sufficiently long axially, the axial position is not critical. The securing element 7 comprises a securing part 8, which is C-shaped in axial section and engages under the slot 18 containing the guide blade end, a shell-like screening part 9 and stop part 10 which is hook-like in axial section. The elements 3 and 7, which are at the greatest possible distance from one another, have defined contact points C1, C2, the extent of which is minimized with regard to low heat conduction, e.g. by periodic interruptions in the circumferential direction, but which are necessary for the mutual support. It would be conceivable to apply local ceramic coatings at C1 and C2 in order to reduce wear and heat conduction further. The securing element 7 acts thermally as an additional radiation shield between the hot seal carrier 3 and the casing 17. As a result, additional thermal insulating materials may be dispensed with in this region. It can also be seen that the hot carrier part 4, according to the invention, does not bear directly against the fastening elements of the casing 17 in the region of the slots 18 and 19. These mechanically critical regions are therefore likewise thermally relieved. In this connection, it is possible, for thermal reasons, to produce only the part 4 from a cobalt alloy; the parts 5, 6, 8, 9 and 10 may be made of nickel alloys, which are more favorable from the point of view of production and wear, or even of steels. Brazing is exclusively envisaged for fixed connections within the parts 3 and 7 using suitable high-temperature brazing filler metals. However, the seal carrier 3 and/or the securing element 7 may also be produced in each case integrally as a turned part from a forged ring or as a casting. On account of the segmented type of construction of the jacket ring 1, the parts 3 and 7 themselves constitute segments, which are in each case lined up in a relatively large number over the casing circumference. In this case, it may be appropriate to offset the joint gaps of the parts 7 in the circumferential direction relative to those of the parts 3.

The invention does not presuppose that a guide blade ring follows downstream of the jacket ring, as illustrated in the FIGURE. A casing liner, for example, may also form the constructional and fluidic continuation of the jacket ring with supporting and stop function for the latter.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A jacket ring for an axial-flow low-pressure turbine region or power-turbine region of a gas turbine, comprising a plurality of segments which are lined up in a circumferential direction and arranged radially outside a moving blade ring with a shroud band and inside a casing of the gas turbine, each of the plurality of segments carrying a run-in lining for at least one sealing tip of the shroud band and which hold a plurality of guide blades in a positive-locking manner to the casing at their radially outer downstream end, the locking performed only by the segments, said guide blades being arranged upstream of the moving blade ring, wherein each segment comprises a hot-gas-side seal carrier provided with the run-in lining and a casing-side securing element supporting at least one upstream guide blade and extending axially to an extent comparable with the seal carrier, wherein the seal carrier and the securing element are at a distance from one another over regions of their surfaces which are as large as possible and only have common heat-conducting contact points in regions which are as small as possible, and wherein the securing element is axially supported directly on the casing of the gas turbine via a stop part.

2. The jacket ring as claimed in claim 1, wherein the run-in lining is designed as a honeycomb structure open toward the shroud band of the moving blade ring and is connected to the seal carrier by brazing.

3. The jacket ring as claimed in claim 1, wherein the securing element comprises a securing part C-shaped in axial section disposed adjacent to the at least one upstream guide blade, a screening part connected by brazing to the securing part, and a securing element stop part which is hook-shaped in axial section and connected by brazing to a casing side of the screening part.

4. The jacket ring as claimed in claim 2, wherein the securing element comprises a securing part C-shaped in axial section disposed adjacent to the at least one upstream guide blade, a screening part connected by brazing to the securing part, and a securing element stop part which is hook-shaped in axial section and connected by brazing to a casing side of the screening part.

5. The jacket ring as claimed in claim 1, wherein the seal carrier comprises a carrier part, connected by brazing to a seal carrier stop part which is hook-shaped in axial section and to the run-in lining.

6. The jacket ring as claimed in claim 3, wherein the seal carrier comprises a carrier part, connected by brazing to a seal carrier stop part which is hook-shaped in axial section and to the run-in lining.

7. The jacket ring as claimed in claim 6, wherein the carrier part has common contact points with the securing part and with a downstream end of the screening part.

8. The jacket ring as claimed in claim 7, wherein the seal carrier and the securing element are made of one of an Fe-, a Ni- and a Co-base alloy.

9. The jacket ring as claimed in claim 7, wherein the carrier part is made of a Co-base alloy, and the run-in lining, the securing element, the screening part, the seal carrier stop part and the securing element stop part are made of a Ni-base alloy.

10. The jacket ring as claimed in claim 1, wherein at least one of the seal carrier and the securing part is formed in an integral manner as one of a turned part and a casting.

11. A jacket ring for an axial-flow low-pressure turbine region or power-turbine region of a gas turbine, comprising:

at least one seal segment disposed inside a casing of the gas turbine in a circumferential direction radially outside a moving blade ring with a shroud band having at least one sealing tip extending radially outward from the shroud band;

a run-in lining affixed to each of the at least one seal segments opposite each sealing tip of the shroud band;

at least one guide blade arranged upstream of the moving blade ring and held in a positive-locking manner to the casing at a radially outer downstream end by at least one of the at least one seal segments, the locking performed only by the at least one seal segment or segments, wherein each seal segment includes a hot-gas-side seal carrier to which the run-in lining is affixed and a casing-side securing element, a first portion of the securing element is disposed substantially parallel to a first portion of the seal carrier and is separated therefrom, and the securing element is supported directly on the casing of the gas turbine.

12. The jacket ring as claimed in claim 11, wherein the run-in lining is designed as a honeycomb structure open toward the shroud band of the moving blade ring and is connected to the seal carrier by brazing.

13. The jacket ring as claimed in claim 11, wherein the securing element comprises a securing part C-shaped in axial section disposed adjacent to the at least one upstream guide blade, a screening part connected by brazing to the securing part, and a securing element stop part which is hook-shaped in axial section and connected by brazing to a casing side of the screening part.

14. The jacket ring as claimed in claim 12, wherein the securing element comprises a securing part C-shaped in axial section disposed adjacent to the at least one upstream guide blade, a screening part connected by brazing to the securing part, and a securing element stop part which is hook-shaped in axial section and connected by brazing to a casing side of the screening part.

15. The jacket ring as claimed in claim 11, wherein the seal carrier comprises a carrier part, connected by brazing to a seal carrier stop part which is hook-shaped in axial section and to the run-in lining.

16. The jacket ring as claimed in claim 13, wherein the seal carrier comprises a carrier part, connected by brazing to a seal carrier stop part which is hook-shaped in axial section and to the run-in lining.

17. The jacket ring as claimed in claim 16, wherein the carrier part has common contact points with the securing part and with a downstream end of the screening part.

18. The jacket ring as claimed in claim 17, wherein the seal carrier and the securing element are made of one of an Fe-, a Ni- and a Co-base alloy.

19. The jacket ring as claimed in claim 17, wherein the carrier part is made of a Co-base alloy, and the run-in lining, the securing element, the screening part, the seal carrier stop part and the securing element stop part are made of a Ni-base alloy.

20. The jacket ring as claimed in claim 11, wherein at least one of the seal carrier and the securing part is formed in an integral manner as one of a turned part and a casting.

* * * * *